United States Patent [19]

Hibino et al.

[11] Patent Number: 4,766,862

[45] Date of Patent: Aug. 30, 1988

[54] IDLING SPEED-UP CONTROL APPARATUS INTERNAL COMBUSTION ENGINE

[75] Inventors: Yoshitaka Hibino; Kogi Kajita, both of Utsunomiya; Satoru Kubo, Hagamachi; Atsushi Totsune, Utsunomiya, all of Japan

[73] Assignee: Honda Giken Kogyo Kabushiki Kaisha, Tokyo, Japan

[21] Appl. No.: 137,628

[22] Filed: Dec. 24, 1987

[30] Foreign Application Priority Data

Dec. 29, 1986 [JP] Japan ..... 61-309469

[51] Int. Cl.[4] ..... F02D 41/16

[52] U.S. Cl. ..... 123/339

[58] Field of Search ..... 123/339, 585

[56] References Cited

U.S. PATENT DOCUMENTS 4,453,518 6/1984 Nakamura et al. ..... 123/339 X
4,467,761 8/1984 Hasegawa ..... 123/339
4,491,108 1/1985 Hasegawa et al. ..... 123/339
4,697,562 10/1987 Boccadoro et al. ..... 123/339

*Primary Examiner*—Tony M. Argenbright
*Attorney, Agent, or Firm*—Armstrong, Nikaido, Marmelstein & Kubovcik

[57] ABSTRACT

The invention is provided with a load detecting means for detecting the value of an electric load connected to an electric generator driven by an internal combustion engine. An idling speed-up means stepwise increases an idling speed of the engine. A control means causes the idling speed-up means to operate when the detected value of the electric load continuously remains above a predetermined value for a predetermined length of waiting time. The control means is provided with a variable setting means which variably sets the waiting time in such a manner that the larger the detected value of the electric load, the shorter the length of the waiting time.

4 Claims, 4 Drawing Sheets

IDLING SPEED-UP CONTROL APPARATUS INTERNAL COMBUSTION ENGINE

FIELD OF THE INVENTION

This invention relates to an idling speed-up control apparatus which prevents an idling engine speed from being lowered by an electric load.

BACKGROUND OF THE INVENTION

One type of idling speed-up control apparatus has been hitherto disclosed in Japanese Unexamined Patent Application Sho No. 58-206847. A load detecting means is provided for detecting the value of an electric load connected to an electric generator which is driven by an engine. A means is provided for setting a control value according to the detected value of the electric load. Also provided is a means for adjusting the air intake amount of the engine basing on this control value, so that an idling speed-up control is proportional to the value of the electric load.

Additional types of idling speed-up control apparatuses have been hitherto disclosed in Japanese Unexamined Patent Application Publications Sho No. 59-103932 or Sho No. 59-103945. An idling speed-up means is provided for stepwise increasing an idling speed of an engine, so that the idling speed-up means operates when the detected value of an electric load, detected by a load detecting means, is above a predetermined value. Thus, the idling speed-up control is an on-off type of control.

The prior art examples are inconvenient because adjusting means for an amount of air intake or control systems of the devices become complicated and are expensive. Of the foregoing prior art examples, the on-off control type of idling speed control is more advantageous than the former example in terms of cost.

However, with the on-off control type of idling speed control, one problem that arises is due to hunting. To prevent this problem from occurring, one arrangement causes an idling speed-up control means to continuously operate when the detected value of the electric load remains above a pre-determined value for a predetermined length of waiting time. Thus, the idling speed-up means is prevented from operating during a momentary increase of the electric load.

However, usually in this case, the waiting time is fixed for the same length of time regardless of the value of the electric load. Accordingly, if the waiting time is set to be comparatively long, the engine speed becomes much lower during the high load before the idling speed-up means is actually operated. The result is an unpleasant vibration and an engine stall. If the waiting time is set to be comparatively short, the engine speed is increased prematurely during a low load. The engine is thus inclined to race, which can often result in a lower fuel economy. Thus, conventional idling speed-up apparatus have had a difficult problem to be equally effective during both a high load and a low load.

SUMMARY OF THE INVENTION

One object of this invention is to provide an idling speed-up control apparatus of an on-off control type which solves the foregoing problems.

The invention is provided with a load detecting means for detecting the value of an electric load connected to an electric generator driven by an internal combustion engine. An idling speed-up means stepwise increases an idling speed of the engine. A control means causes the idling speed-up means to operate when the detected value of the electric load continuously remains above a predetermined value for a predetermined length of waiting time. The control means is provided with a variable setting means which variably sets the waiting time in such a manner that the larger the detected value of the electric load, the shorter the length of the waiting time.

DESCRIPTION OF THE PREFERRED EMBODIMENTS

Next, the operation of an apparatus of this invention will be explained as follows:

When the detected value of the electric load, detected by the load detecting means, is below the predetermined value, the idling speed-up means does not operate. When the detected value is above the predetermined value, but the electric load is comparatively small in value, the idling speed-up means will not operate, unless a comparatively long waiting time has lapsed so that an engine may be restrained from racing.

When the electric load is greatly increased in its value, the idling speed-up means operates with a comparatively short waiting time. Thus, any lowering of the engine speed may be restrained.

Embodying examples of this invention will now be explained with reference to the accompanying drawings.

Figure 1:
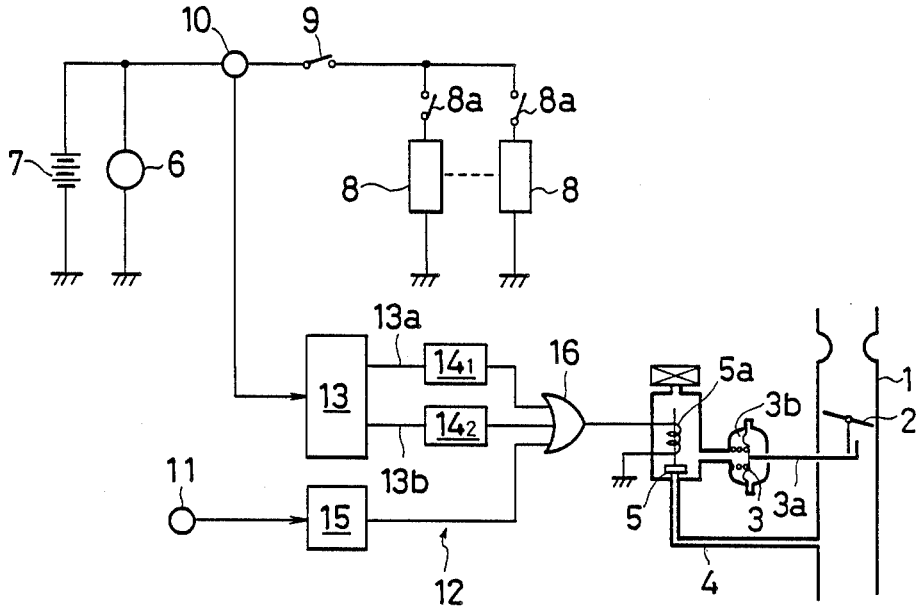
FIG. 1 is a block diagram showing one example of an apparatus of this invention.

FIG. 1 shows an intake passage of an engine 1 and a throttle valve 2 is interposed in the intake passage 1. A diaphragm 3 is provided and has an operation rod 3*a* of the throttle valve 2 connected thereto. A back pressure chamber 3*b* thereof is connected, through a negative pressure passage 4, to the intake passage 1 downstream of the throttle valve 2. An electromagnetic opening and closing valve 5 is interposed in the negative pressure passage 4, so that as the opening and closing valve 5 is opened, an intake negative pressure on a downstream side of the throttle valve 2 may be introduced into the back pressure chamber 3*b*. The intake negative pressure acts through the diaphragm 3 so as to have the throttle valve 2 open by a predetermined opening degree from its fully closed condition. Thus, an idling speed-up means is designed to stepwise increase an idling speed of the engine. The idling speed-up means is constructed from the diaphragm 3 and the opening and closing valve 5.

Referring to the drawings, an electric generator 6 is driven by the engine. A battery 7, each electric load 8, and each operation switch 8*a* are connected, through a load circuit having an ignition switch 9 interposed therein, to the electric generator 6. An ampere meter 10 which serves as a load detecting means, is connected to the load circuit. The opening and closing valve 5 may be controlled to open and close by a control circuit 12, which serves as a control means. The control circuit 12 has as input a signal from the ampere meter 10 and a signal from a water temperature sensor detecting a cooling water temperature Tw of the engine.

The control circuit 12 is provided with a load discrimination circuit 13 which determines if the electric load detected by the ampere meter 10 falls in three ranges, 6A or below 6A, above 6A to including 9A, and above 9A (shown in FIGS. 5). That is, if a load current I falls in the range 6A to 9A, it is output as a high level signal through a first output terminal 13*a*. When the load current I falls in the range above 9A, it is output through a second output terminal 13*b*. A first delay timer $\mathbf{14}_1$ outputs a high level idling speed-up signal when the high level signal is continuously output from the first output terminal 13*a* for a comparatively long waiting time, for instance, 3 seconds. A second delay timer $\mathbf{14}_2$ outputs a high level idling speed-up signal when the high level signal is continuously output from the second output terminal 13*b* for a comparatively short waiting time, for instance, 0.5 seconds. A water temperature discrimination circuit 15 outputs a high level idling speed-up signal when the cooling water temperature Tw, detected by the foregoing water temperature sensor 11, is below a predetermined temperature, for instance, 70° C. An OR circuit 16 has as input the signals from the two delay timers $\mathbf{14}_1$, $\mathbf{14}_2$ and the water temperature discrimination circuit 15. A solenoid 5*a* of the foregoing opening and closing valve 5 is connected to the output of the OR circuit 16.

During engine warm-up, when the cooling water temperature Tw is below 70° C., the solenoid 5*a* is energized by the idling speed-up signal from the water temperature discrimination circuit 15. The solenoid 5*a* causes the opening and closing valve 5 to open, thereby causing the throttle valve 2 to open to a predetermined degree from its fully closed condition so as to provide an idling speed-up operation.

Figure 5A:
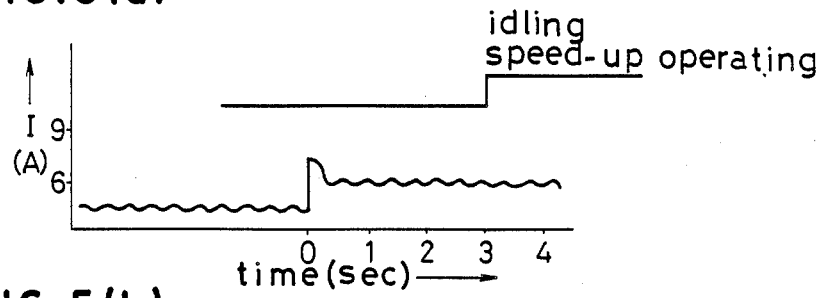

Even when the cooling water temperature Tw is above 70° C., if the load current I is increased anywhere between the range 6A and 9A and continuously remains in this condition for 3 seconds, as shown in FIG. 5*a*, the solenoid 5*a* is energized by the idling speed-up signal from the first delay timer $\mathbf{14}_1$, so that an idling speed-up operation occurs.

Figure 5B:
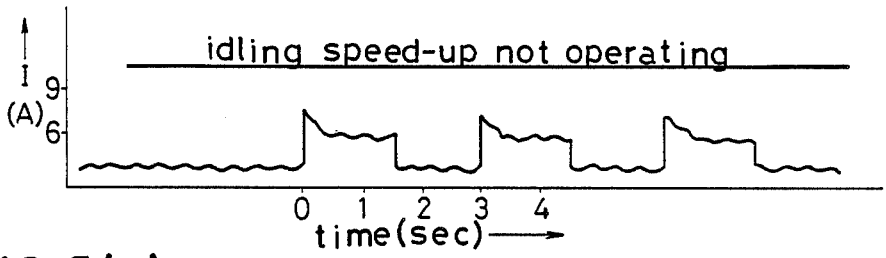
Figure 5C:
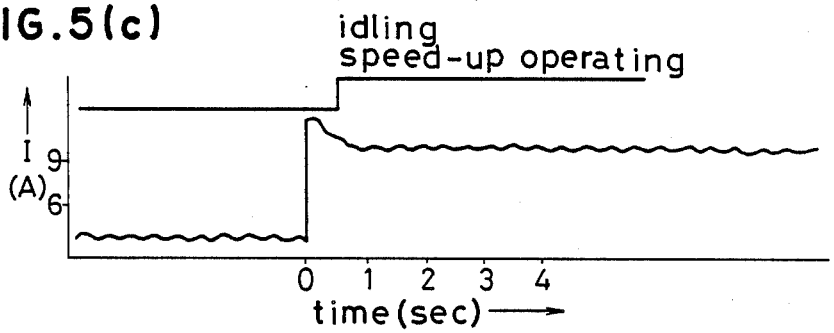
Figure 5D:
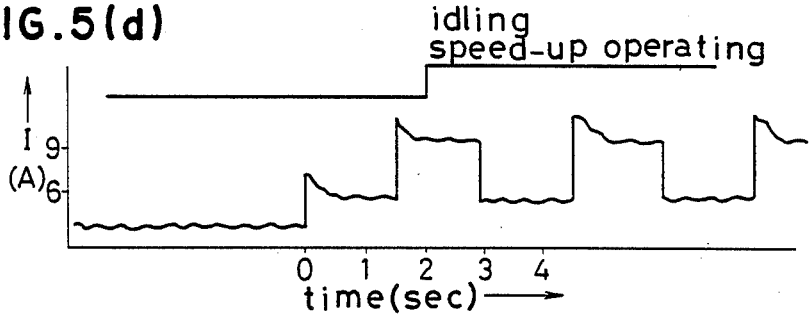

Additionally, when the load current I is increased to have a value of above 9A, as shown in FIG. 5*c*, the idling speed-up signal is output from the second delay timer $\mathbf{14}_2$ at the point in time that this condition is continued for 0.5 seconds, so that an idling speed-up operation will occur at an early stage.

In this case, even if the load current I is intermittently increased to have a value ranging from 6A to 9A due merely to an electric current flowing to an intermittently operating type electric load 8 such as a wiper motor or the like as shown in FIG. 5*b*, an idling speed-up operation does not occur. However, an increase to this extent of the load current I does not cause the engine speed to be lowered very much. Furthermore, when the load current is decreased, the engine speed is restored to the usual idling speed, and thus no problems arise.

If, the time lapse, after the load current I has increased to reach 6A (or higher) in the range 6 to 9A, is less than 5 seconds, and the load current I is subsequently increased to have a value above 9A due to an electric current flowing to an intermittently operating type electric load 8 as shown in 5*d*, then an idling speed-up operation will occur in 0.5 seconds after the intermittent operation. Thus, any lowering of the engine speed will be prevented.

Figure 2:
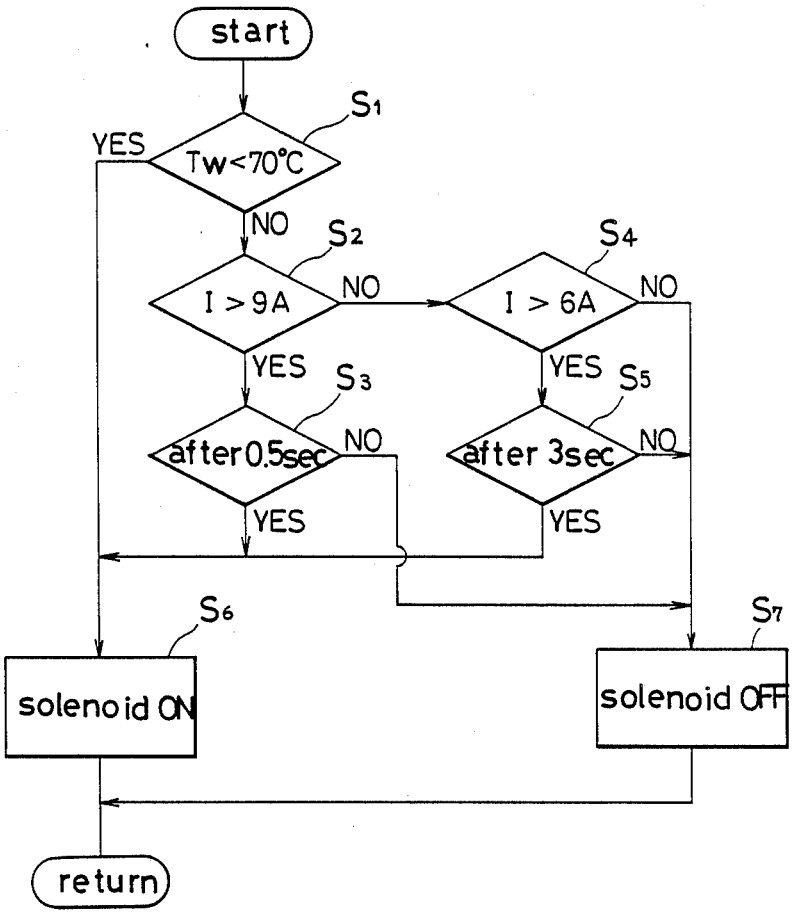
FIG. 2 is a flowchart showing one example of a program when a microcomputer is used for a control means.
Figure 3:
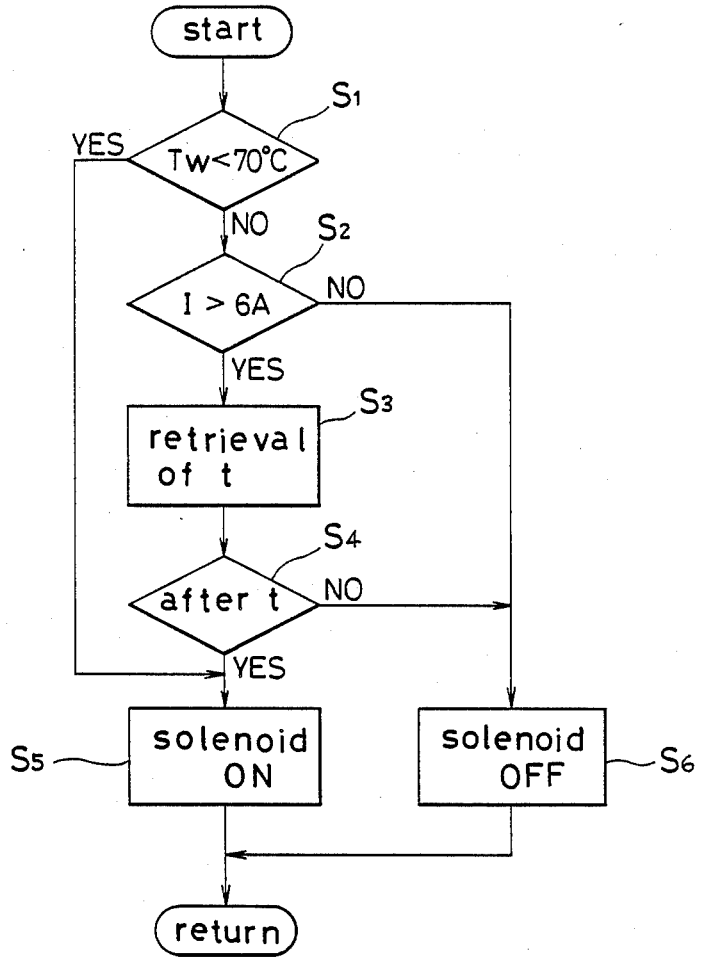
FIG. 3 is a flowchart showing another program.

It is possible to use a microcomputer for the control means, and a program in this case is shown in FIGS. 2 and 3.

In the example shown in FIG. 2, at $S_1$ a determination is made whether or not the cooling water temperature Tw is below 70° C. When it is above 70° C., at $S_2$, it is determined whether or not the load current I is above 9A.

If the load current is above 9A, at $S_3$, it is determined whether or not this condition has continued for 0.5 seconds or not. When it is determined that the condition has continued for 0.5 seconds, at $S_6$ the solenoid 5*a* is turned ON to open the opening and closing valve 5.

When the load current I is below 9A, at $S_4$, it is determined whether or not the load current I is above 6A. When the result of the determination is YES, at $S_5$, it is determined whether or not this condition has continued for 3 seconds. When it is determined that the condition has continued for 3 seconds, at $S_6$ the opening and closing valve 5 is opened in the same manner as above. When the cooling water temperature Tw is below 70° C., the opening and closing valve 5 is unconditionally opened at $S_6$. On the other hand, if the result of the determination at $S_3$, $S_4$, $S_5$ is NO, at $S_7$, the solenoid 5*a* is turned OFF to close the opening and closing valve 5.

Figure 4:
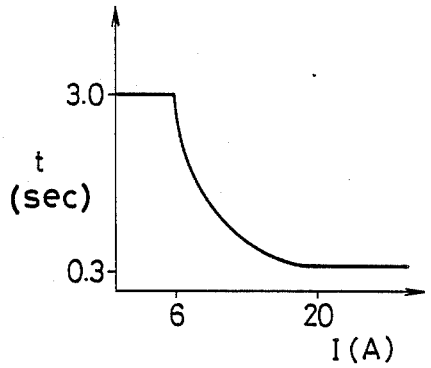
FIG. 4 is a graph showing a data table of waiting time used in the flowchart of FIG. 3, and FIGS. 5*a*, 5*b*, 5*c*, and 5*d* are graphs each showing the relation between a load current and an idling speed-up operation.

In the second example shown in FIG. 3, at $S_1$ it is determined whether or not the cooling water temperature Tw is below 70° C. When below 70° C., at $S_5$, the solenoid 5*a* is turned ON to open the opening and closing valve 5. When the temperature is above 70° C., at $S_2$, it is determined whether or not the load current I is above 6A. When the result is YES, at $S_3$, at which, from a data table having such characteristics as shown in FIG. 4, relating to the load current I and the waiting time t, a length of waiting time t corresponding to the detected value of the load current I is retrieved. At $S_4$, it is determined whether or not, from the time when the load current I has increased above 6A, the length of waiting time t retrieved as $S_3$ has passed. When the result is YES, at $S_5$ the solenoid 5*a* is turned ON to open the opening and closing valve 5, so that the length of waiting time t may be set to be continuously variable in accordance with the load current I.

When it is determined at $S_2$ that the load current is below 6A or at $S_4$ that the waiting time t is less than the desired waiting time of the data table, at $S_6$ the solenoid 5*a* is turned OFF to close the opening and closing valve 5.

In the foregoing embodying example, by opening the opening and closing valve 5, the throttle valve is opened through the diaphragm 3. However, this invention is equally applicable also to a case where the idling speed-up control means is constructed so that an opening and closing valve is interposed in a passage for supplying a gas mixture to the intake passage 1 located downstream of the throttle valve 2.

It is also possible to use such a type of load detecting means as one designed to detect an F terminal voltage of a regulator connected to the electric generator 6 or a voltage or an electric current of a field coil, as disclosed in the foregoing Japanese Unexamined Patent Application Publication Sho Nos. 59-103932 or 59-103945.

Thus, according to this invention, the length of waiting time is shortened as the value of the electric load is increased, so that racing of the engine caused by a prematurely initiated idling speed-up operation at the time of a low load can be restrained. Additionally, any lowering in engine speed at the time of high load can be restrained. Even with an on-off type of idling speed-up control, a stable idling operation can be obtained both during a high load and a low load.

It is apparent that, in this invention, working modes different in a wide range can be formed on the basis of the invention without deviating from the spirit and scope of the invention This invention is not restricted by it specific working mode except being limited by the appended claims.

What is claimed is:

1. An idling speed-up control apparatus in an internal combustion engine comprising:

an electric generator driven by the internal combustion engine;

a load detecting means for detecting the value of an electric load connected to the electric generator;

an idling speed-up means for stepwise increasing an idling speed of the engine; and a control means for causing the idling speed-up means to operate when detecting value of the electric load continuously remains above a predetermined value for a predetermined length of waiting time, the control means includes a variable setting means for variably setting the waiting time such that the larger the detected value of the electric load, the shorter the length of the waiting time.

2. An idling speed-up control apparatus as claimed in claim 1, wherein the variable setting means is constructed so that the length of waiting time is stepwise varied in accordance with the detected value of the electric load.

3. An idling speed-up control apparatus as claimed in claim 1, wherein the variable setting means is constructed so that the length of waiting time is continuously varied in accordance with the detected value of the electric load.

4. An idling speed-up control apparatus as claimed in any one of claims 1, 2, or 3, wherein the control means is constructed so that the variable setting means causes the idling speed-up means to operate, regardless of the value of the electric load, when an engine temperature is below a predetermined set temperature.

* * * * *

UNITED STATES PATENT AND TRADEMARK OFFICE

CERTIFICATE OF CORRECTION

PATENT NO. : 4,766,862

DATED : August 30, 1988

INVENTOR(S) : Yoshitaka HIBINO et al

It is certified that error appears in the above-identified patent and that said Letters Patent is hereby corrected as shown below:

On the cover page, Item [54], line 2, "INTERNAL" should read --IN INTERNAL--;

Item [75], "Kogi Kajita" should read --Koji Kajita--.

Column 1, line 3, "INTERNAL" should read --IN INTERNAL--.

Signed and Sealed this

Seventh Day of March, 1989

*Attest:*

DONALD J. QUIGG

*Attesting Officer*

*Commissioner of Patents and Trademarks*